United States Patent [19]

Beeghly et al.

[11] 4,232,406

[45] Nov. 11, 1980

[54] WATER CLOSET VENTILATING SYSTEM WITH VACUUM BREAKER VALVE

[76] Inventors: Lester R. Beeghly; George E. Gilchrist, both of 4400 N. Paulina Ave., Chicago, Ill. 60640

[21] Appl. No.: 40,432

[22] Filed: May 18, 1979

[51] Int. Cl.[3] ..... E03D 9/04; A47K 13/00

[52] U.S. Cl. ..... 4/213; 4/218; 4/216

[58] Field of Search ..... 4/213, 214, 215, 216, 4/209, 217

[56] References Cited

U.S. PATENT DOCUMENTS

| | | | |
|---|---|---|---|
| 3,192,539 | 7/1965 | Martz | 4/213 X |
| 3,495,282 | 2/1970 | Taggart | 4/213 |
| 3,626,554 | 12/1971 | Martz | 4/213 |
| 3,691,568 | 9/1972 | Martz | 4/213 |
| 3,703,010 | 11/1972 | Russell | 4/216 |
| 3,939,506 | 2/1976 | Pearson | 4/213 |
| 4,007,498 | 2/1977 | Pearson | 4/213 |
| 4,011,608 | 3/1977 | Pearson | 4/213 |
| 4,017,916 | 4/1977 | Pearson | 4/213 |

*Primary Examiner*—Henry K. Artis
*Attorney, Agent, or Firm*—Merriam, Marshall & Bicknell

[57] ABSTRACT

A system for ventilating the toilet bowl of a water closet of the type having a standpipe in the flush tank thereof and wherein the lower end of the standpipe is connected to the conduit which extends between the flush tank and the flush ring in the toilet bowl and the upper end of the standpipe extends above the normal level of the water in the flush tank. The inlet of a suction fan communicates with the space above the level of the water in the flush tank and the outlet of the fan is connected to a suitable point of discharge for gases withdrawn from the toilet bowl. A vent passage extends from the exterior of the flush tank to the space above the level of the water in the flush tank, and a normally closed flapper valve, which is connected by linkage to a float that floats on the surface of the water in the flush tank, moves to an open position to prevent a vacuum from developing in the space above the level of the water in the flush tank when the tank is flushing the toilet bowl and the water level in the tank drops.

8 Claims, 5 Drawing Figures

FIG. 2
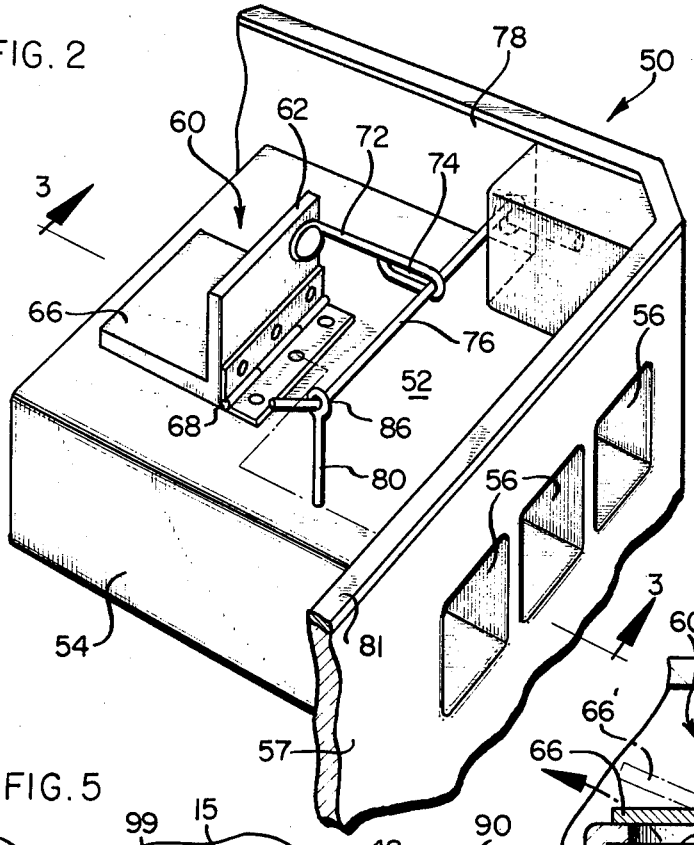
FIG. 3
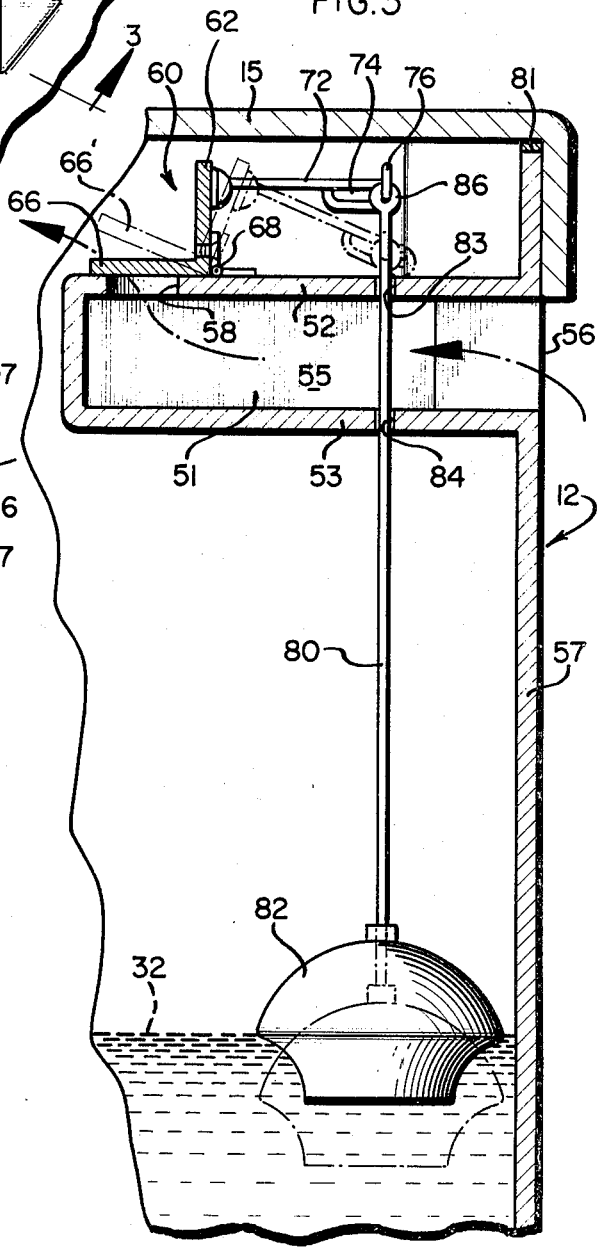
FIG. 5
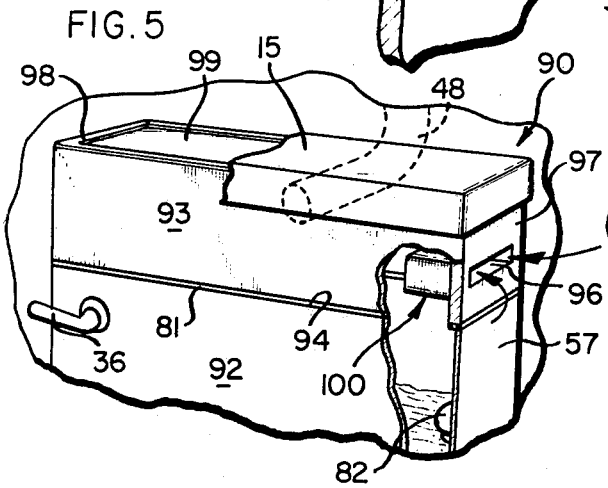
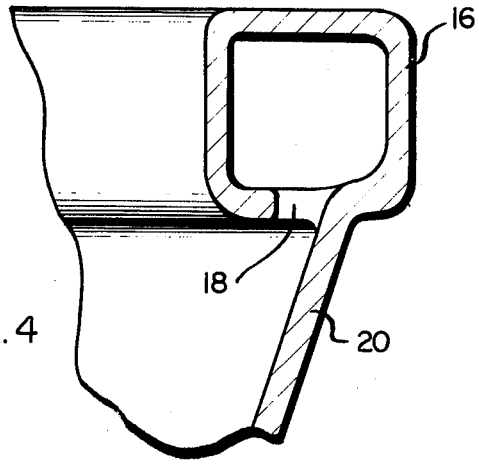
FIG. 4

WATER CLOSET VENTILATING SYSTEM WITH VACUUM BREAKER VALVE

This invention relates to a system for ventilating the bowl of a water closet, and more particularly relates to a system for ventilating a water closet wherein a valve is provided for venting the space above the water level in the flush tank to the atmosphere during flushing of the bowl so that the flow of water is not restrained by vacuum in the flush tank.

While the need for systems for ventilating water closets has long been recognized, the prior art systems have not been entirely successful and thus have not come into widespread use. See for example: U.S. Pat. Nos. 1,342,716, Johnston; 1,381,710, Krantz; 1,622,993, Cameron; 1,675,841, Cohoon; 1,955,579, DeMalaussine; 2,216,008, Heuacker; 2,277,165, Stebbing, et at.; 2,297,935, Baither; 2,778,033, Majauskas; 3,087,168, Huso; 3,102,275, Raymond; 3,192,539, Martz; 3,495,282, Taggart; 3,681,790, Dooley; 3,763,505, Zimmerman; 3,781,923, Maisch, et at.; 3,955,218, Ramsey; 4,011,608, Pearson; and 4,044,408, Pearson. The present system is simple, effective, and is capable of being adapted to existing water closets without major modifications.

While it has been known to ventilate water closets by drawing air from the bowl through the flush ring, up the standpipe into the airspace above the level of the water in the flush tank, and then out of the building by an appropriate fan and piping arrangement, the prior art devices have not included a means for venting the airspace in the flush tank to the atmosphere when the tank is flushing the bowl. Thus, if the fan was powerful enough to be truly effective in ventilating the water closet, it would also interfere with the flushing action by creating a partial vacuum in the airspace in the flush tank. The present invention alleviates that problem by incorporating a means for venting the airspace in the tank to the atmosphere in response to the lowering of the water level which occurs as flushing begins. In one embodiment, the invention takes the form of a float connected to a flapper valve which vents the airspace above the water level in the tank to the atmosphere upon lowering of the water level in the tank. In another and preferred embodiment, a spacer is placed on the flush tank and the original cover of the flush tank is then placed on the spacer. The flapper valve mechanism is mounted in the spacer along with a venting means.

BRIEF DESCRIPTION OF THE DRAWINGS

FIG. 2 is a fragmentary perspective view of the vacuum breaking valve mechanism employed in the ventilating system of the present invention;

FIG. 3 is a sectional view along line 3—3 in FIG. 2 and illustrating in full and broken lines the manner in which the valve mechanism is actuated in response to lowering of the water level in the tank;

FIG. 4 is a fragmentary sectional view taken along line 4—4 in FIG. 2; and FIG. 5 is a fragmentary perspective view of the upper portion of a flush tank having a spacer between the top of the tank and lid, such spacer comprising part of another water closet ventilating system embodying the features of the present invention.

DETAILED DESCRIPTION

Figure 1:
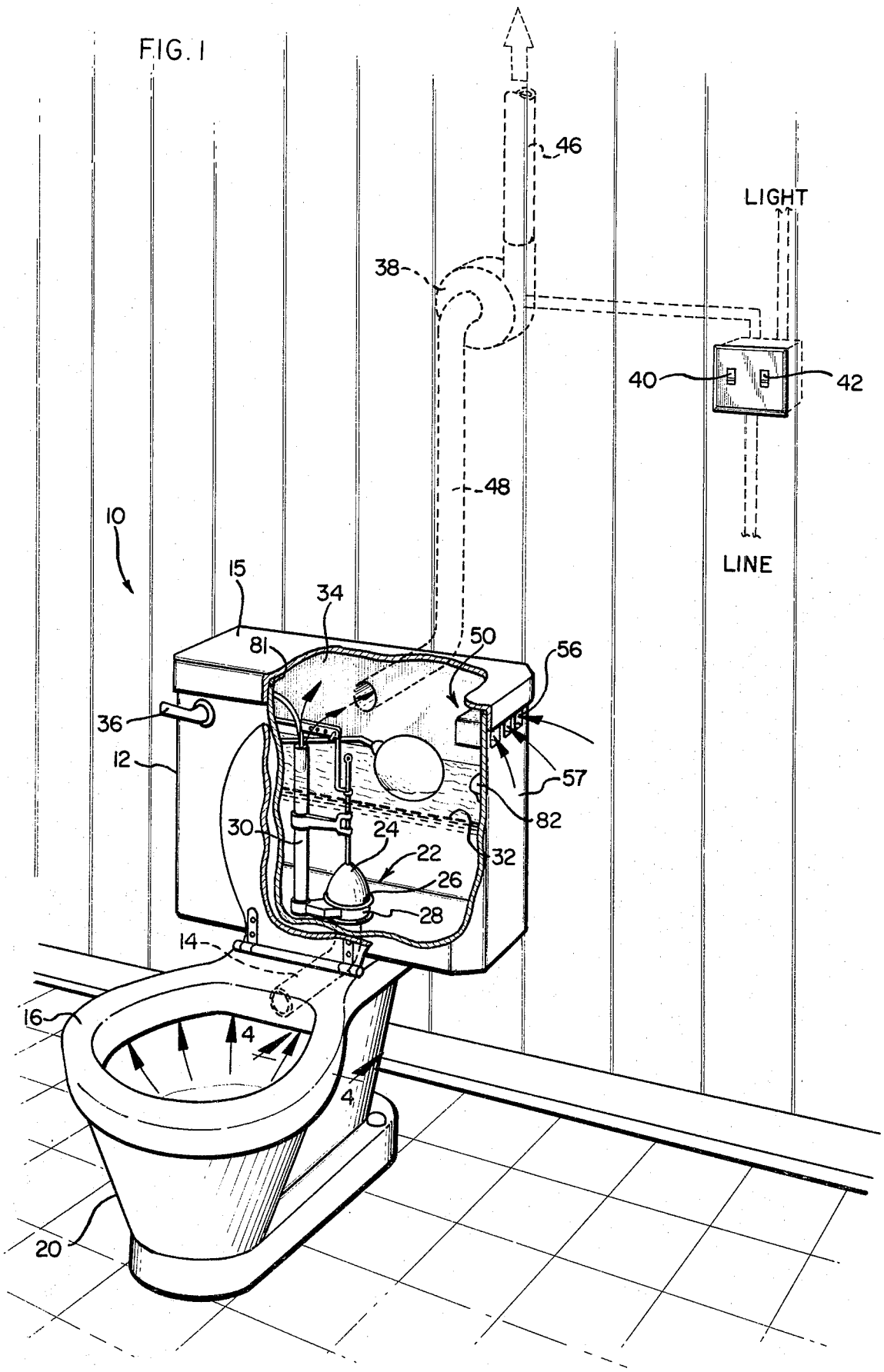
FIG. 1 illustrates a water closet incorporating a ventilating system embodying the features of the present invention.

FIG. 1 illustrates a water closet 10 incorporating a ventilating system embodying the features of the present invention. Water closet 10 is of a conventional construction insofar as the flushing mechanism is concerned. The water closet 10 thus includes a tank 12 having a lid 15, the tank 12 being connected to a toilet bowl 20 by a pipe 14. Upon flushing, water stored in flush tank 12 flows through connecting pipe 14 into flush ring 16, thence through apertures 18 (FIG. 4) connecting flush ring 16 with bowl 20. In the inactive state, water is prevented from flowing into bowl 20 by ball valve 22 consisting of floatable ball 24 and seat 26 formed in "T" coupling 28 joining connecting pipe 14 with standpipe 30. Standpipe 30 rises above the normal water level 32 in flush tank 12 and thus connects airspace 34 in the top of flush tank 12 with connecting pipe 14, flush ring 16, and ultimately with bowl 20.

The flushing operation of water closet 10 is similar to that of conventional water closets. Upon depression of handle 36, floatable ball 24 is lifted from seat 26 formed in "T" coupling 28. Water stored in flush tank 12 flows through "T" coupling 28 into connecting pipe 14, into flush ring 16 and into bowl 20 through apertures 18. Upon emptying of flush tank 12, floatable ball 24 engages seat 26 and thus prevents water from flowing from flush tank 12 into connecting pipe 14. As the water level in flush tank 12 rises, floatable ball 24 is held in the closed position by the pressure of water upon it allowing flush tank 12 to be refilled.

Having described the operation of the conventional part of the water closet 10 shown in FIG. 1, the novel ventilating systems will now be described. Such system comprises an exhaust fan 38, which is controlled by a wall switch 40, the fan 38 being connected to an exhaust duct 46 leading out of the structure and to inlet duct 48 which is connected to the interior of the flush tank 12 above the normal level 32 of water in the tank. When wall switch 40 is closed, exhaust fan 38 is activated constantly. Alternately, the fan 38 could be connected to wall switch 42, which controls the operation of one or more lights (not shown) in the room in which the water closet 10 is installed. With such a circuit, the fan 38 would be turned on when either switch 40 or light switch 42 is closed. Regardless of the circuitry utilized, when exhaust fan 38 is activated, air is drawn out of bowl 20 through apertures 18 (FIG. 4) into flush ring 16 through connecting pipe 14, through "T" coupling 28, through standpipe 30 into airspace 34, through inlet duct 48 to exhaust duct 46 and finally out of the structure.

To accomplish this ventilation, it is desirable that exhaust fan 38 be relatively powerful but in the water closet ventilating systems known to the prior art, if the power of the exhaust fan was high, then in operation, it would create a partial vacuum in airspace 34 which would interfere with the flushing action by slowing the flow of water out of flush tank 12 into bowl 20. In addition, vacuum in the airspace 34 would prevent the ball 24 from engaging its seat 26 when the tank 12 is empty. These difficulties are overcome in the present invention by providing venting means, indicated generally at 50, for venting the airspace 34 in flush tank 12 to the atmosphere. As shown in FIGS. 2 and 3, the venting means 50 includes means defining a passage 51 extending through a side wall 57 of the tank 12 and having one end 56 opening in the side wall 57. The other end, indicated at 58, of the passage 55 is in the form of an aperture which communicates with the airspace 34 in flush tank 12. The passage 55 is defined by spaced, upper and lower horizontal walls 52 and 53 and vertically extending side walls 54 and 55.

Valve means in the form of a flapper valve 60 is provided for preventing or permitting flow through the aperture 58. Flapper valve 60 is L-shaped and includes a vertical leg 62 and a horizontal leg 66, the leg 66 being movable between its full line position overlying the aperture 58 and a broken line position 66' spaced from the aperture 58. The valve 60 is pivotably mounted on the upper horizontal wall 52 of the passage 55 by a hinge 68, the valve 60 being moved by linkage connected and responsive to movement of a float 82 which floats on the surface of the water in the tank 12. Such linkage includes a draw rod 72 connected at one end to the leg 62 and having a loop 74 formed in the opposite end thereof. The loop 74 surrounds a link 76, which is pivotally mounted on rear wall 78 of the tank 12. Link 76 is pivotable about a horizontal axis which is perpendicular to the axis of rotation of hinge 68. Link 76 extends through a loop 86 in push rod 80 which is connected to the float 82 and which extends through openings 83 and 84 in the upper and lower walls 52 and 53, respectively, of the passage 55. Preferably, draw rod 72 projects perpendicularly from vertical leg 62 of flapper valve 60, link 76 being free to pivot only in a vertical plane. The length of draw rod 72 from vertical leg 62 to the outer end of loop 74 is equal to the perpendicular distance from leg 62 to the plane in which link 76 is free to pivot.

Restricting movement of link 76 to a vertical plane is accomplished by journaling push rod 80 in upper wall 52 and lower wall 53 of passage 55 so that it is substantially free only to reciprocate along its axis but not to deviate substantially therefrom. Link 76 can be restrained by making the inside diameter of loop 86 substantially equal to or only slightly greater than the thickness of link 76. The length of push rod 80 is adjusted so that when the water in flush tank 12 is at its normal or storage level 32, push rod 80 presses up on link 76, thus forcing horizontal leg 66 of valve member 60 down and thereby sealing aperture 58. However, push rod 80 should be short enough so that when the level of the water in flush tank 12 drops slightly, valve member 60 pivots about hinge 68 to its broken line position in FIG. 3 causing horizontal leg 66 to uncover the aperture 58 and establish communication between the airspace 34 and the exterior of flush tank 12. Consequently, water closet 10 will flush normally. Upon refilling of the flush tank, horizontal leg 66 pivots over aperture 58, thus resuming normal ventilation of bowl 20. Preferably, a strip of resilient sealing material 81 (FIGS. 1, 2 and 3) is secured to the upper edge, indicated at 82, of the tank 12 to prevent loss of vacuum in the airspace 34 when the system is in operation.

In FIG. 5, the upper portion of a flush tank 92 of another water closet 90, is illustrated. The water closet 90 incorporates a ventilating system comprising a preferred embodiment of the invention. Since the ventilating system employed in the water closet 90 utilizes most of the components employed in the ventilating system of the water closet 10, like reference numerals have been used to identify identical parts.

The ventilating system of the water closet 90 differs from that of the previous embodiment in that the main functional components of the system are mounted in a rectangular housing or spacer 93, which is mounted on the upper edge 94 of the flush tank 92. The lid 15 of the flush tank 92 overlies the upper surface, indicated at 95, of the spacer 93 and the inlet end, indicated at 96, of the vent passage of the system is provided in the side wall, indicated at 97, of the spacer 93, instead of in the side wall, indicated at 57, of the flush tank 92.

As in the previous embodiment, a strip of resilient sealing material 81 is secured to the upper edge 94 of the tank 92 to prevent loss of vacuum in the airspace above the level of the water in the tank 92. In addition, a strip of resilient sealing material 98 may be secured around the periphery of the upper surface, indicated at 99, of the spacer 93 to cushion and stabilize the lid 15.

The ventilating system of the water closet 90 includes venting means, indicated generally at 100, which is mounted in the spacer 93. The venting means 100 includes a flapper valve 60, a draw rod 72, and a link 76, which are identical to and function in the same manner as their counterparts in the venting means 50. However, the push rod (not shown) of the venting means 100 is somewhat longer than the push rod 80 of the venting means 50.

The ventilating system utilized in the water closet 90 operates in the same manner as the system employed in the water closet 10. Consequently, reference should be made in this specification to the description of operation of the ventilating system employed in the water closet 10 for an understanding of the operation of the ventilating system employed in the water closet 90. The ventilating system utilized in the water closet 90 permits the system to be installed in existing water closets with only minor alterations.

Modifications and variations may be effected without departing from the spirit of the invention as defined in the appended claims.

We claim:

1. In a system for ventilating water closets of the type having a flush tank for storing water at a storage level, said flush tank having a cover adapted to fit thereon, a bowl having a flush ring with a plurality of apertures formed around the periphery of said bowl, conduit means connecting said flush tank with said bowl, a standpipe mounted within said flush tank and having its lower end communicating with said flush ring and its upper end communicating with the space above the normal level of the water in said flush tank, and means for effecting the withdrawal of gases from said space and consequently from said bowl, the improvement of which comprises the inclusion of means responsive to lowering of the water level in said flush tank for venting the space above the level of the water in said tank to the atmosphere during flushing so as to eliminate any vacuum in said space and thereby prevent any restriction of the flow of water from said flush tank into said bowl.

2. The system of claim 1, wherein said means responsive to lowering of the water level in said flush tank comprises a float adapted to float on the surface of the water in said flush tank, and a valve controlled by said float.

3. The system of claim 2, wherein said venting means includes means defining a passage having one end connected to the atmosphere and its other end connected to said space, a flapper valve coacting with said other end of said passage and movable between positions permitting and preventing flow through said other end, and linkage connecting said float with said flapper valve for moving said valve into its closed position when the water level in said flush tank is at said storage level and for moving said flapper valve into its open position upon lowering of the water level in said flush tank below said storage level.

4. The system of claim 3, wherein said linkage includes a draw rod connected to said flapper valve, a pivotably mounted link connected to said draw rod and movable in a plane perpendicular to said draw rod, and a vertically shiftable push rod connected to said float and said link, said push rod being movable from an upper to a lower position in response to lowering of the water level in said flush tank from said storage level, whereby said flapper valve moves from its closed to and remains in its open position while said bowl is being flushed.

5. The system of claim 4, wherein said flapper valve is generally L-shaped and arranged with one leg normally extending vertically and another leg normally extending horizontally, said draw rod being connected to said vertically extending leg.

6. The system of claim 1, including a spacer adapted to be mounted on the top of said flush tank and adapted to receive said cover, and said venting means is mounted in said spacer.

7. The system of claim 3, including a spacer adapted to be mounted on the top of said flush tank and adapted to receive said cover, said passage defining means comprises spaced walls in said spacer, and said linkage is carried by at least one of said walls.

8. The system of claim 4, including a spacer adapted to be mounted on the top of said flush tank and adapted to receive said cover, said passage defining means includes spaced, upper and lower, horizontal walls and vertical side walls in said spacer, said flapper valve is pivotally mounted on one of said horizontal walls, and said push rod extends through vertically aligned opening in said horizontal walls of said passage defining means.

* * * * *